US008616739B2

(12) United States Patent
Plunk

(10) Patent No.: US 8,616,739 B2
(45) Date of Patent: Dec. 31, 2013

(54) VANDAL RESISTANT LIGHTING FIXTURE AND METHOD OF MANUFACTURE THEREOF

(75) Inventor: Carlton Bruce Plunk, Saltillo, MS (US)

(73) Assignee: Koninklijke Philips N.V., Endhoven (NL)

( * ) Notice: Subject to any disclaimer, the term of this patent is extended or adjusted under 35 U.S.C. 154(b) by 257 days.

(21) Appl. No.: 13/155,484

(22) Filed: Jun. 8, 2011

(65) Prior Publication Data

US 2012/0314429 A1 Dec. 13, 2012

(51) Int. Cl.
*F21V 21/00* (2006.01)

(52) U.S. Cl.
USPC ..... 362/374; 362/375; 362/376; 362/369; 362/398

(58) Field of Classification Search
USPC ..... 362/374, 375, 369, 398
See application file for complete search history.

(56) References Cited

U.S. PATENT DOCUMENTS 6,669,355 B2 * 12/2003 Layne et al. ..... 362/294
7,631,993 B2 * 12/2009 Russello et al. ..... 362/374
7,654,684 B1 * 2/2010 Wight et al. ..... 362/183
8,079,738 B1 * 12/2011 Schlappi et al. ..... 362/375
2008/0278958 A1 * 11/2008 Jiang ..... 362/374
2009/0128331 A1 * 5/2009 Lopez et al. ..... 340/572.1

FOREIGN PATENT DOCUMENTS

CN 201723008 U 1/2011
WO 2010083550 A1 7/2010

* cited by examiner

*Primary Examiner* — Evan Dzierzynski

(57) ABSTRACT

A vandal resistant lighting fixture including a base with a first side wall and a flange extending from the first side wall; a cover having a second side wall having interior and exterior peripheries and a cap extending from the second side wall, the cap having an opening through which light from an illumination source may pass; a securing mechanism rotatably securing the cover to the base when the cover is rotated in a first direction relative to the base to a secured position; and/or a magnetically operable latching mechanism having latched and unlatched positions. With the cover in the secured position, the latching mechanism prevents rotation of the cover in a second direction opposite the first direction when the latching mechanism is in the latched position. A corresponding magnetic key may be configured to provide a magnetic force to toggle the latching mechanism between the latched and unlatched settings.

20 Claims, 8 Drawing Sheets

VANDAL RESISTANT LIGHTING FIXTURE AND METHOD OF MANUFACTURE THEREOF

The present system relates to a lighting fixture and, more particularly, to a vandal resistant lighting fixture with enhanced security features and a method for manufacture thereof.

Typically, luminaires for outdoor public lighting such as pathway lighting, etc., include security features to protect them from vandals and the like who may attempt to access, damage, and/or steal the luminaires. Typically, outdoor-type luminaires employ exposed tamper resistant screws to secure their cases closed so as to prevent unauthorized access to interior portions of the luminaires. However, exposed screws are undesirable from an aesthetic as well as security standpoints. For example, with respect to security, exposed parts of the tamper resistant screws can provide the vandal with information necessary to access the luminaire (e.g., screw head type, size, etc.) which can then be used to match the required tools (e.g., security bits, etc.) to remove portions of the luminaire so as to access interior portions of the luminaire and/or to remove the luminaire from its mount.

The present application discloses a lighting fixture apparatus which includes a hidden latching to prevent the opening of the top cap of the lighting fixture apparatus by unauthorized individuals such as vandals and the like. To enhance aesthetics, a lighting fixture of the present system requires no exposed hardware. Further, as a lighting fixture of the present system uses a magnetic key (e.g., a magnet, etc.) to unlatch its latching mechanism for latching a cover of the lighting fixture, maintenance persons can easily unlatch and thereafter open the cover of the lighting fixture to gain access to an internal cavity or cavities of the lighting fixture for various purposes such as service, replacement, repair, bulb replacement, etc. Moreover, as the locking mechanism hidden, it is difficult for unauthorized persons such as vandals, etc., to determine how to unlatch and/or open the cover of a lighting fixture in accordance with embodiments of the present system.

Accordingly, there is disclosed a vandal resistant lighting fixture, including a base having a first side wall and a flange extending from the first side wall, the flange defining a first opening, a cover having a second side wall and a cap extending from the second side wall, the second sidewall having interior and exterior peripheries, the cap having a second opening through which light from an illumination source may pass; a securing mechanism configured to rotatably secure the cover to the base when the cover is rotated in a first direction relative to the base to a secured position; and/or a magnetically operable latching mechanism having latched and unlatched settings, wherein when the cover is in the secured position, the latching mechanism prevents rotation of the cover relative to the base in a second direction opposite the first direction when the latching mechanism is in the latched position.

The magnetically operable latching mechanism may further include a bracket attached to the base; and/or a biasing member pivotally attached to the bracket so as to rotate about a pivot axis and into latched and unlatched positions respectively corresponding with latched and unlatched positions of the magnetically operable latching mechanism.

Moreover, the biasing member may include proximal and distal ends and an engagement tab situated proximate to the distal end and configured to be biased against the inner periphery of the second sidewall. It is further envisioned that the light fixture may include at least one stop tab situated at the inner periphery of the second sidewall. A location and/or a number of stop tabs may be set in accordance with a configuration of the securing mechanism. Further, the at least one stop tab may be configured to engage a portion of the biasing member when the biasing member is in the latched position. Moreover, the biasing member may include a coupling portion configured to magnetically couple to a magnetic key to receive a force from the magnetic key to rotate the biasing member about the pivot axis to toggle the latching mechanism between the latched and unlatched positions. It is further envisioned that the bracket may include a "Z" shaped bracket having first and second folds, the second fold situated at the opening of the flange. However, it is also envisioned that the bracket may include a single fold or other shapes such as an "L" shape etc., Further, it is envisioned that the bracket may be formed integrally with the base. Further, when the cover is in the secured position, the latching mechanism may be configured to allow rotation of the cover relative to the base in the second direction opposite the first direction when the latching mechanism is in the unlatched position.

In accordance with yet second aspect of the present system, there is disclosed a method for forming a vandal resistant lighting fixture, the method may include acts of: forming a base having a first side wall and a flange extending from the first side wall; forming a cover having a second side wall and a cap, the second sidewall having opposed inner and outer peripheries;

forming an opening in the cap through which light from an illumination source may pass; configuring a securing mechanism to rotatably secure the cover to the base when the cover is rotated in a first direction relative to the base to a secured position; and/or forming a magnetically operable latching mechanism having latched and unlatched settings, wherein when the cover is in the secured position, the latching mechanism prevents rotation of the cover relative to the base in a second direction opposite the first direction when the latching mechanism is in the latched setting.

Moreover, in accordance with the method, the act of forming the magnetically operable latching mechanism may further include acts of: attaching a bracket to the base; and/or pivotally attaching a biasing member having proximal and distal ends to the bracket such that the biasing member may rotate about a pivot axis and has latched and unlatched positions respectively corresponding with latched and unlatched settings of the latching mechanism.

Further, it is envisioned that the method may include acts of forming an engagement tab at a proximal end of the biasing member; and/or situating the engagement tab such that the engagement tab is biased against the inner periphery of the second sidewall of the cover. Moreover, the method may include an act of forming one or more stop tabs at the inner periphery of the second sidewall of the cover. Further, the one or more stop tabs may be configured to engage the engagement tab when the biasing member is in the latched position and bypass the engagement tab when the biasing member is in the unlatched position.

Moreover, the method may include an act of forming the biasing member from a ferromagnetic material configured to couple to a magnetic key to receive a force from the magnetic key to toggle the biasing member between the latched and unlatched positions respectively. Moreover, the method may include acts of folding the bracket twice in opposite directions between proximal and distal ends of the bracket so as to form a "Z" shaped bracket; and/or situating a portion of the bracket at the opening of the flange. Further, the method may include an act of configuring the biasing member such that when the cover is in the secured position, the biasing member allows rotation of the cover relative to the base in the second direction opposite the first direction when the biasing member is in the unlatched position.

In accordance with yet second aspect of the present system, there is disclosed a lighting fixture which may include: a base having a first side wall and a flange extending from the first sidewall, the first side wall having an outer periphery; a cover having second sidewall and a cap extending from the second sidewall, the second sidewall having inner and outer peripheries, the inner periphery of the second sidewall configured to extend about the outer periphery of the first sidewall of the base; an opening situated in the cover through which light from an illumination source may pass; a securing mechanism configured to rotatably secure the cover to the base when the cover is rotated in a first direction relative to the base to a secured position; and/or a magnetically operable locking mechanism including a biasing member having latched and unlatched settings, wherein when the cover is in the secured position, the latching mechanism prevents rotation of the cover relative to the base in a second direction opposite the first direction when the biasing member is in the latched setting.

In accordance with the lighting fixture, the biasing member may include a magnetic coupling portion configured to magnetically couple to a magnetic key to receive a force from the magnetic key to rotate the biasing member about the pivot axis between the latched or unlatched positions of the biasing member. Further, the lighting fixture may include a magnetic key which may be configured to magnetically couple to the biasing member when the magnetic key is situated at the outer periphery of the second sidewall of the cover. Moreover, the biasing member may include a spring situated between a flange attached to the base and the inner periphery of the other sidewall of the cover.

The invention is explained in further detail, and by way of example, with reference to the accompanying drawings wherein.

Figure 13:
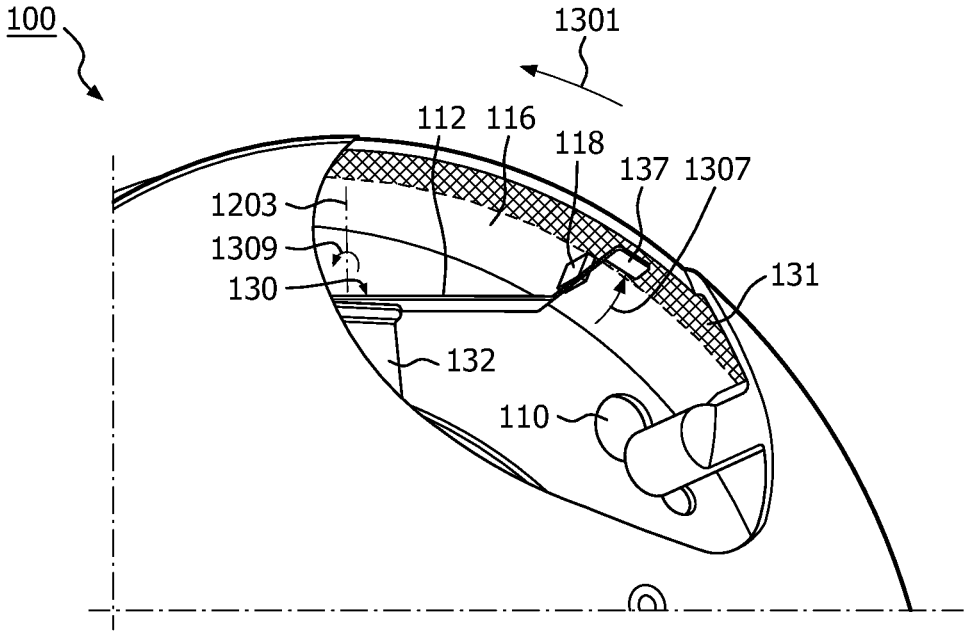
Figure 14:
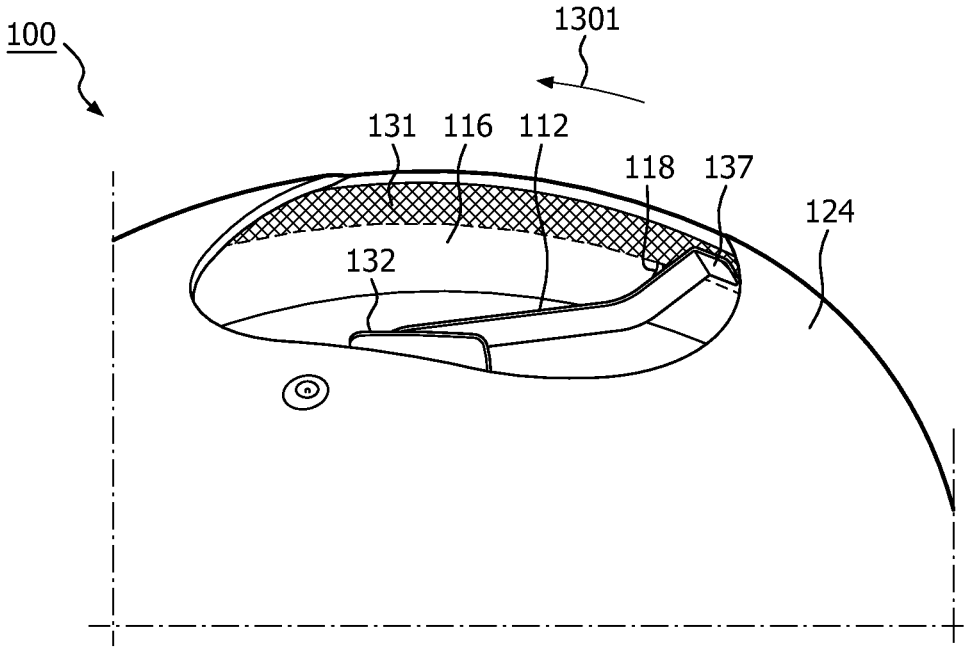

FIG. 13 is a detailed top perspective view of a portion of the lighting fixture with the cover partially rotated in a removal direction during the cover removal process in accordance with embodiments of the present system; and FIG. 14 is a detailed top perspective view of a portion of the lighting fixture with the cover further rotated in a removal direction during the cover removal process in accordance with embodiments of the present system.

The following are descriptions of illustrative embodiments that when taken in conjunction with the following drawings will demonstrate the above noted features and advantages, as well as further ones. In the following description, for purposes of explanation rather than limitation, illustrative details are set forth such as architecture, interfaces, techniques, element attributes, etc. However, it will be apparent to those of ordinary skill in the art that other embodiments that depart from these details would still be understood to be within the scope of the appended claims. Moreover, for the purpose of clarity, detailed descriptions of well known devices, circuits, tools, techniques and methods are omitted so as not to obscure the description of the present system. It should be expressly understood that the drawings are included for illustrative purposes and do not represent the scope of the present system. In the accompanying drawings, like reference numbers in different drawings may designate similar elements.

Figure 1:
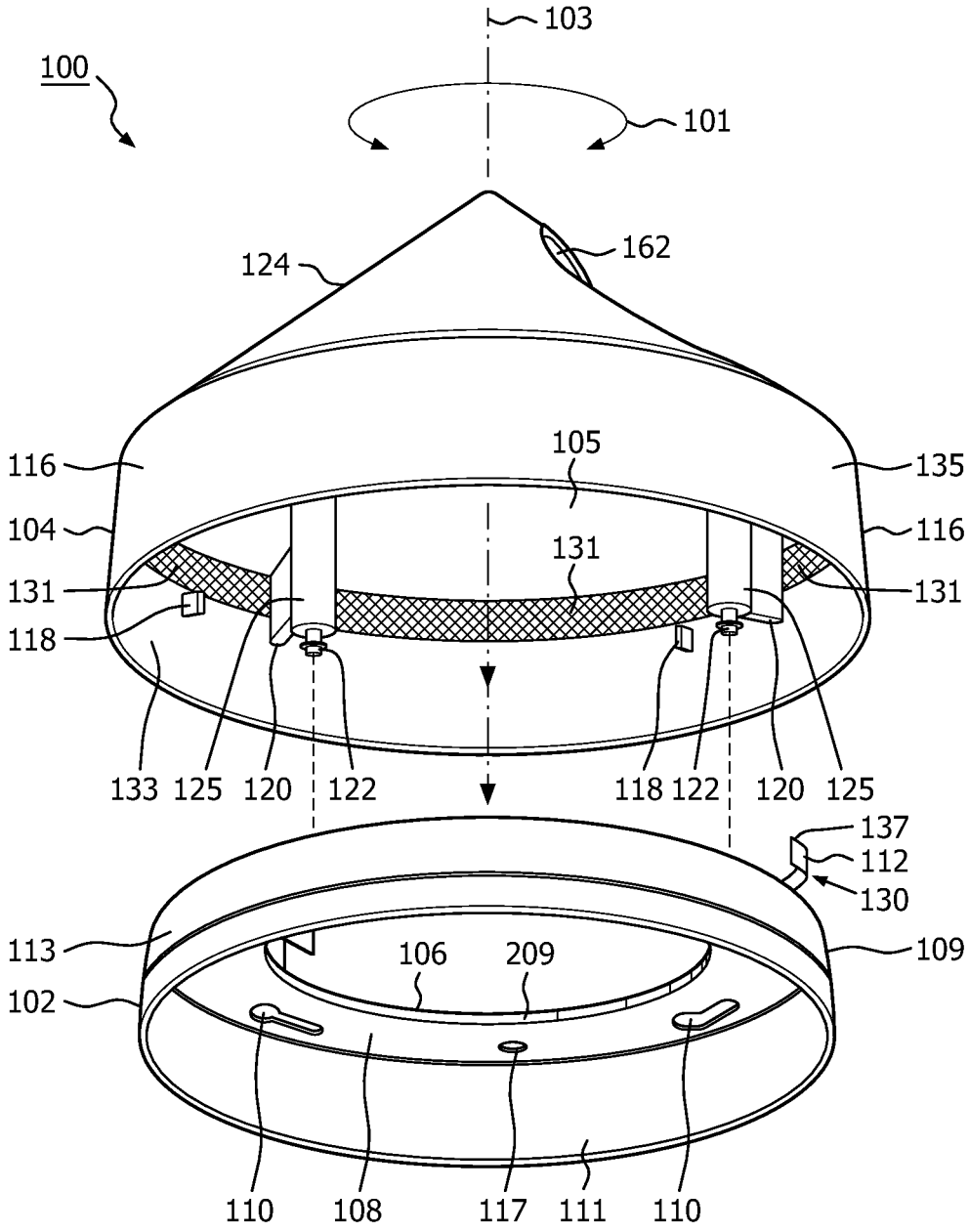
FIG. 1 is a bottom perspective view of a lighting fixture in accordance with embodiments of the present system.

FIG. 1 is a bottom perspective view of a lighting fixture 100 (e.g., a luminaire, a lighting fixture, etc.) in accordance with embodiments of the present system. The lighting fixture 100 may include a base 102 and a cover 104 which may be releasably secured to the base 102 such that each may be latched to each other using a latching mechanism 130.

The base 102 may include one or more of a side wall 109, a flange 108, and an opening 106. The latching mechanism 130 may be attached to a portion of the base 102 such as the flange 108. The flange 108 may include a securing mechanism to secure the cover 104 to the base 102. The securing mechanism may include, for example, a mechanism which may permit rotation of the cover 104 relative to the base 102 about a vertical axis of the lighting fixture 100 such as axis 103 as illustrated by arrow 101. Accordingly, securing mechanism may include openings such as elongated openings 110 which are configured to receive corresponding portions of the cover 104, such as studs each having a head such as screws 122 or the like, and allow the cover 104 to rotate relative to the base 102 as illustrated by the arrow 101. Accordingly, the top 104 may be secured to or removed from the base 102 by rotating the top 104 relative to the base 102 to engage or disengage the securing mechanism. The latching mechanism 130 may be provided to prevent rotation of the top 104 in a release direction relative to the base 102 when the cover 104 is secured to the base 102 as will be discussed below. The flange 108 may extend from the sidewall 109 and may include the opening 106. The sidewall 109 may have opposed inner and outer peripheries 111 and 113, respectively.

The opening 106 may be shaped and/or sized such that components such as wires, etc. which provide power and/or control functions to the lighting fixture 100 may pass therethrough or be situated therein. The base 102 may be shaped and/or sized such that it may be attached to a standard electrical box or the like and may be mounted to various outdoor structures such as bollards, walls, etc. Accordingly, the side wall 109 of the base 102 may be round, square, etc.

Further, the base 102 may include one or more openings to receive screws, etc., to attach the base 102 to a selected electrical box. For example, the base may include openings 117 in the flange 108 through which mounting devices such as screws, studs, bolts, etc., may pass to mount the lighting fixture to an outdoor fixture such as an electrical box, a wall, a bollard, etc. As the mounting devices may be hidden within a cavity of the lighting fixture 100, they will be difficult to loosen and/or remove without gaining access to interior portions of the lighting fixture 100. Accordingly, it would be difficult for unauthorized persons to remove the lighting fixture 100 without gaining access to the interior portion of the lighting fixture. For the sake of clarity, the openings 117 are not shown in all drawings.

The cover 104 may include a sidewall 116 and a cap 124. The cap 124 may extend from the sidewall 116 and may define at least a portion of the opening 162. The sidewall 116 and/or the cap 124 may define at least a portion of a cavity 105 and/or an opening 162 leading to the cavity 105. Sidewall 116 and/or the cap 124 may be shaped and/or sized to provide access to, and/or protect components within the lighting unit 100. For example, in accordance with embodiments of the present system, the cap 124 may form a shape such as a cone type shape. However, other shapes such as a sphere, rectangle, etc., are also envisioned in accordance with other embodiments of the present system. These components may include one or more sensors such as a motion sensor, an image capture device (e.g., camera to capture image information, etc.), optical sensors (e.g., a light meter to sense ambient light, etc.), microphones (e.g., to detect sound, etc.), etc. Accordingly, for example, an opening may provide a port for sound to be captured by the microphone, while another opening may be provide for the camera to capture images. The openings may include protective covers, if desired. The sensors may be attached to the cover 104 and/or to the base 102. The sensors may provide the information to a processor which may process the information and act accordingly as may be readily appreciated.

Posts 125 may include studs with heads such as screws 122 suitable for attachment to the securing mechanism of the base 102 such as the elongated openings 110. A plurality of studs/openings are provided so as to assure the cover 104 may be secured and/or may rotate relative to the base 102 as shown by the arrow 101. The posts 125 may be located and/or secured to the cover 104 by bosses such as post connectors 120 which may extend from the sidewall 116 of the cover 104. The cover 104 may include stop tabs 118 which may engage other portions of the latching mechanism 130 such as a spring 112. Accordingly, the stop tabs 118 may be attached to portions of the cover 104 such as the sidewall 116 and may be aligned so as to engage the spring 112 when the cover 104 is in a position in which it is secured to the base 102 (e.g., a secured or locked position). In accordance with embodiments of the present lighting fixtures, a single stop tab 118 may be utilized. However, in accordance with other embodiments of the present lighting fixtures, a plurality of stop tabs 118 and/or springs 112 may be utilized for example to simplify alignment of the cover 104 relative to the base 102. Accordingly, the stop tab 118 may be engaged by the spring 112 of the latching mechanism 130 when spring 112 is in the latched position. The cover 104 may include a solar panel mounted on, for example, the cap 124 to generate electricity for the lighting fixture. Accordingly, the lighting fixture 100 may include a wired and/or wireless (e.g., battery operated rechargeable) illumination source.

A release area 131 may be defined as an area of an inner periphery 133 of the sidewall 116 which may be located at or above a plane of a top of the stop tabs 118 as illustrated by the crosshatching. An outer periphery 135 of the side wall 116 is located opposite the inner periphery 133. The release area 131 will be discussed below with reference to removal of the cover in the description of FIGS. 12 through 14 below.

Figure 2:
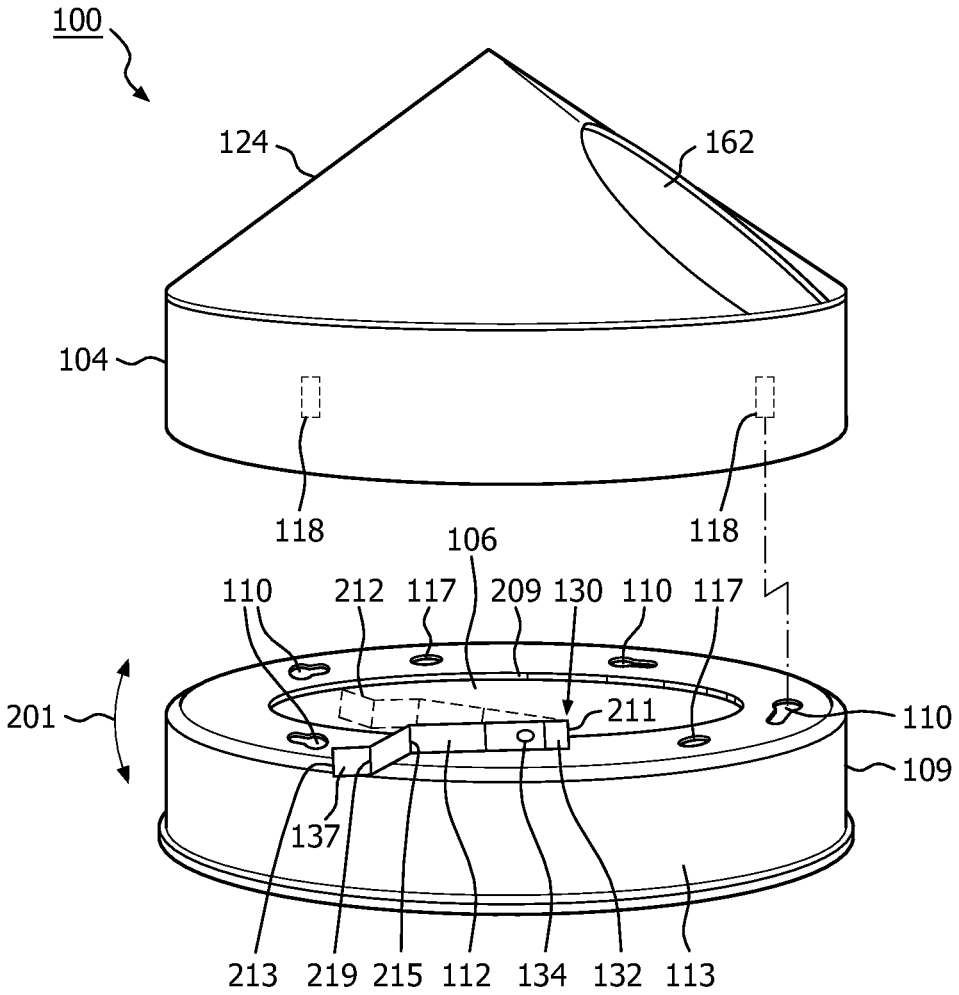
FIG. 2 is a top perspective view of the lighting fixture in accordance with embodiments of the present system.
Figure 3:
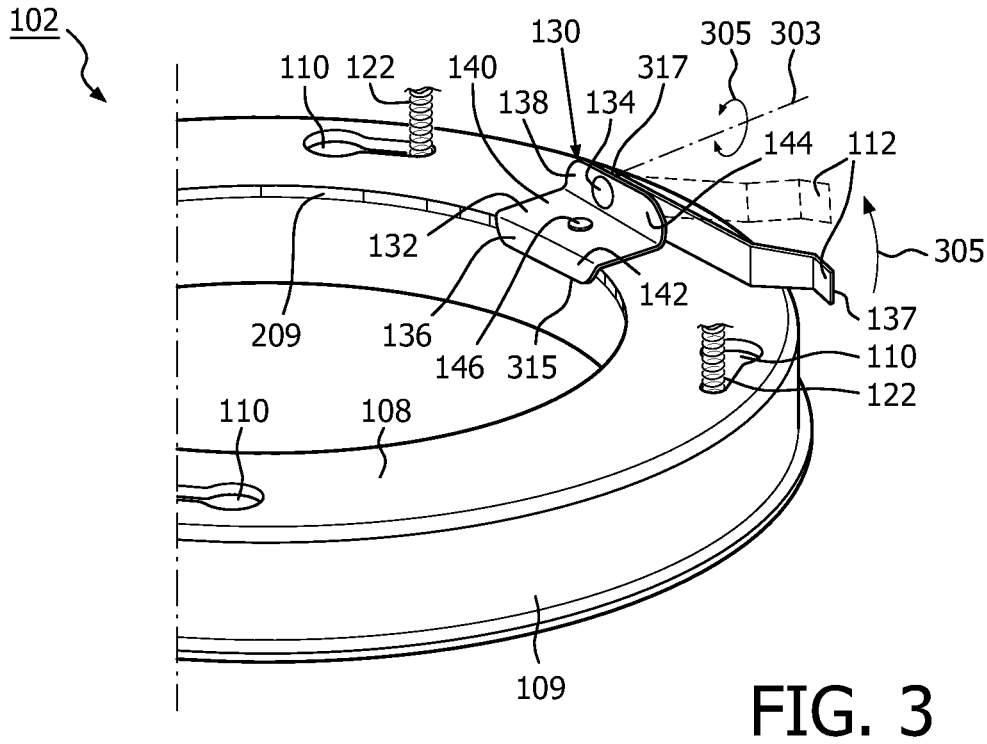
FIG. 3 is a detailed top perspective view of a portion of the lighting fixture in accordance with embodiments of the present system.

FIG. 2 is a top perspective view of the lighting fixture 100 in accordance with embodiments of the present system. The latching mechanism 130 may include a bracket 132 and the spring 112 which may be attached to the bracket 132 using any suitable attachment method such as a rivet 134 which in accordance with embodiments of the present system may pivotally couple the spring 112 to the bracket 132. However, other methods of attachment such as snap rivets, latches, screws, bolts, hinges, etc., which may permit rotation of the spring 112 relative to the bracket 132 are also envisioned. The spring 112 may rotate about its pivot axis (as shown by arrow 201) from a latched position (shown) to an unlatched position as illustrated by the dashed outline of the spring 112 indicated as spring 212. The spring 112 may include proximal and distal ends 211 and 213, respectively. An engagement tab 137 suitable for engaging an adjacent stop tab 118 of the cover 104 may be located at the distal end 213 of the spring 112 while the rivet 134 may be located adjacent to the proximal end 211 of the spring 112. The spring 112 may include folds such as folds 217 and 215 which may be folded in directions which are opposite to each other and may define proximal, central, and distal portions of the spring 112. However, it is also envisioned that in accordance with embodiments of the present system the spring 112 may include a single or no folds. Moreover, it is envisioned that the spring 112 may include one or more twists along its axis. A biasing member may be provided to position the spring 112 in the secure position FIG. 3 is a detailed top perspective view of a portion of the lighting fixture 100 in accordance with embodiments of the present system. The bracket 132 may be attached to the flange 108 of the base 102 using any suitable method such as a rivet 146. The bracket 132 may include proximal and distal ends 315 and 317, respectively, and first and second folds 142 and 144, respectively, which may be folded in opposite directions to each other. The bracket 132 may include a proximal portion 136 located between the first fold 142 and the proximal end 315, a distal portion 138 may be located between the second fold 144 and the distal end 317, and a center portion 140 situated between the first and second folds 142 and 144, respectively, and/or proximal and distal portions 136 and 138, respectively. In accordance with embodiments of the present system, the bracket 132 may form a "Z" or other shapes such as an "L" shape, etc. However, it is also envisioned that the bracket 132 may comprise a flange integrally formed with the base 102 etc. as described further herein. The proximal portion 136 of the bracket 132 may engage an inner periphery 209 of the flange 108 so as to align the bracket 132 relative to the bracket, and, thus, prevent rotation of the bracket 132 during normal use. The bracket 132 may be formed from suitable material such as a metal or a polymer, etc. It is also envisioned that the bracket 132 may be formed integrally with the base 102 and in which case the bracket 132 may include only a section similar to the distal portion 138 which may extend from the flange 108 of the base 102. Portions of the screws 122 of the cover 104 are shown extending through the elongated openings 110. Although the spring is shown in the latched position, when subject to an external force such as a force from a magnet (e.g., a magnetic force from a magnet), the spring 112 may rotate to an unlatched position. This rotation may cause the spring 121 to rotate relative to the bracket 132 and about its pivot axis 303 (as shown by arrow 305), which may correspond with an axis of the rivet 134.

Figure 4:
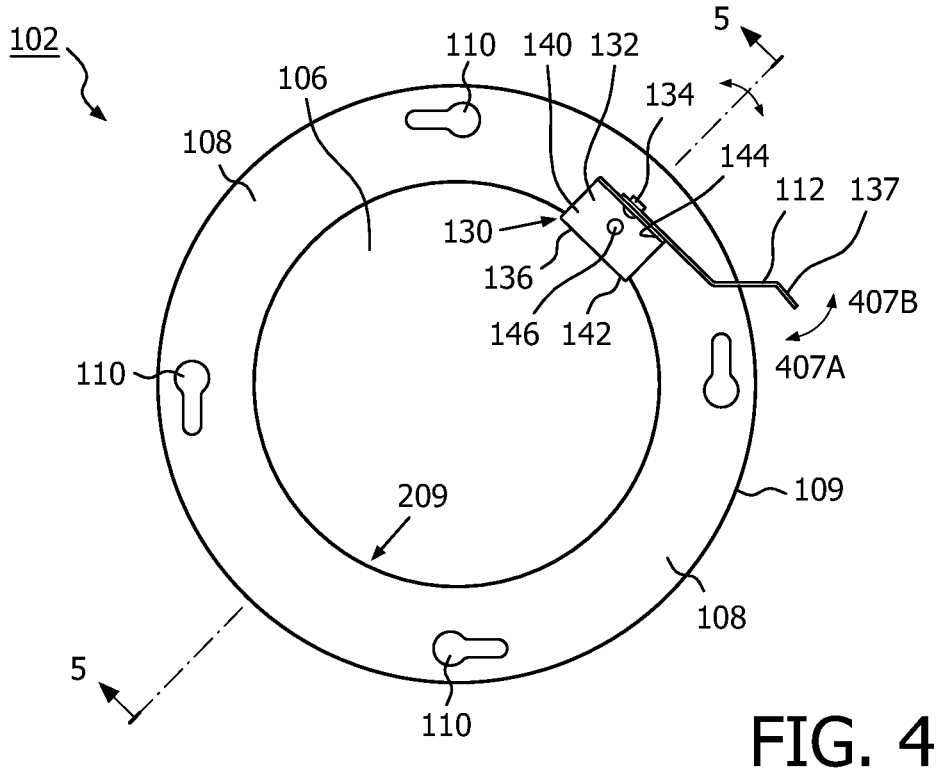
FIG. 4 is a detailed top view of a base of the lighting fixture in accordance with embodiments of the present system.

FIG. 4 is a detailed top view of the base 102 of the lighting fixture 100 in accordance with embodiments of the present system. The spring 112 may provide a biasing force (e.g., see arrow 407B) and may be deflected in a direction illustrated by arrows 407A, 407B. Accordingly, the engagement tab 137 may be deflected (e.g., see arrow 407A) by the cover 104 when the cover 104 is placed over the engagement tab 137 and the engagement tab 137 may be biased against an interior portion of the sidewall 116 of the cover 104 and may engage an adjacent stop tab 118 of the cover 104 to prevent rotation of the cover 104 relative to the base 102 when the spring 112 is in the latched position.

Figure 5:
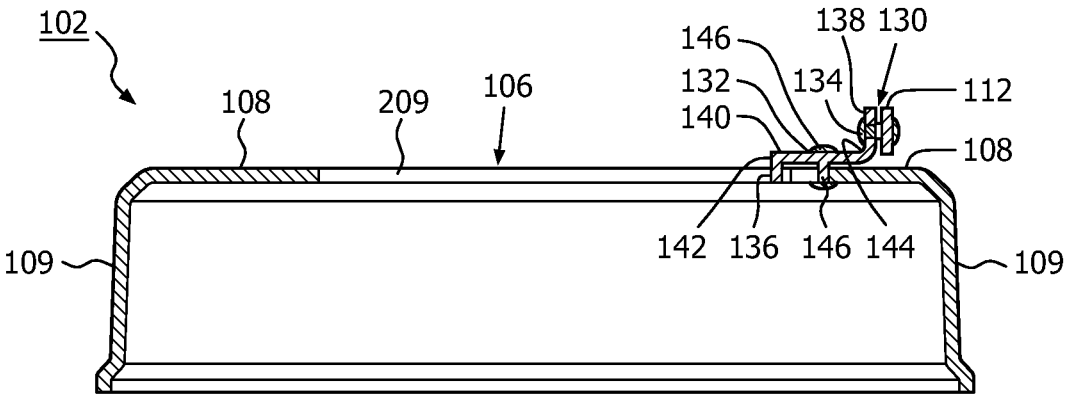
FIG. 5 is a cross-sectional view of the base of the lighting fixture taken along lines 5-5 of FIG. 4 in accordance with embodiments of the present system.

FIG. 5 is a cross-sectional view of the base 102 of the lighting fixture 100 taken along lines 5-5 of FIG. 4 in accordance with embodiments of the present system. The flange 108 extends from the side wall 109 of the base 102.

The bracket 132 may be attached to the base 102 by the rivet 146. However, other suitable methods such as screws, friction fitting, bonding (e.g., thermal, etc.), adhesives, latches, etc., are also envisioned.

Figure 6:
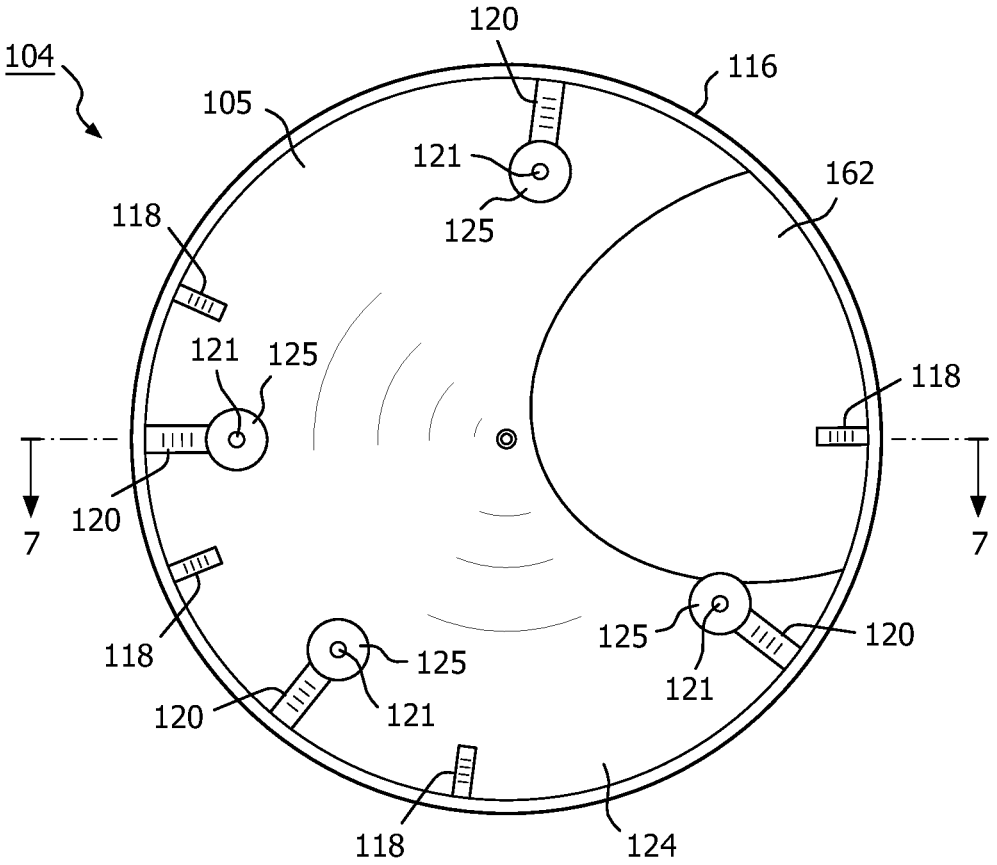
FIG. 6 is a bottom view of the cover of the lighting fixture in accordance with embodiments of the present system.

FIG. 6 is a bottom view of the cover 104 of the lighting fixture 100 in accordance with embodiments of the present system. The opening 162 may include a lens for transmitting light in a desired direction and, therefore, may be shaped and/or sized accordingly to receive the lens. The opening 162 may be asymmetrically offset with respect to a center of the cover 104. However, it is also envisioned the opening 162 may be symmetrically located with respect to the center of the cover 104. The posts 125 may include openings 121 suitable to receive threaded portions of the screws 122 and may be formed integrally with, or separate from, the cover 104. Further, a depth of the openings 121 may be controlled such the screws may only be inserted to a desired depth. The post connectors 120 may secure corresponding posts 125 to the sidewall 116 of the cover 104. The number as well as the configuration of the posts 125 may correspond with a number and configuration of the openings 110 of the base 102. The cavity 105 of the cover 104 may be shaped and/or sized to receive a one or more portions of a lighting assembly suitable to provide lighting from one or more illumination sources such as fluorescent lamps, high intensity discharge (HID) lamps, light emitting diodes (LEDs), LED light engines, LED cover changing engines (e.g., for illuminating portions of the cover 104 such as the cap 124 when made from a light transmissive material, etc.), etc.

Figure 7:
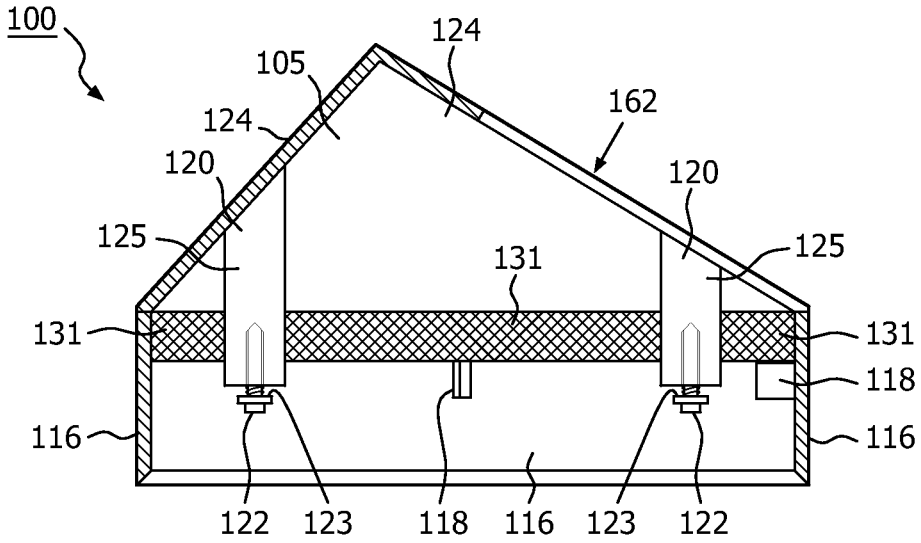
FIG. 7 is a cross sectional view of the cover of the lighting fixture taken along lines 7-7 of FIG. 6 in accordance with embodiments of the present system.

FIG. 7 is a cross sectional view of the cover 104 of the lighting fixture 100 taken along lines 7-7 of FIG. 6 in accordance with embodiments of the present system. The stop tabs 118 may extend from the sidewall 116 of the cover 104 and may be aligned such that one of the stop tabs 118 may contact the spring 112 when rotation of the cover 104 from a secured position relative to the base 102 is attempted when the spring 112 is in the latched position. In accordance with embodiments of the present system, the cap 124 may form a dome however other shapes are also envisioned.

Figure 8:
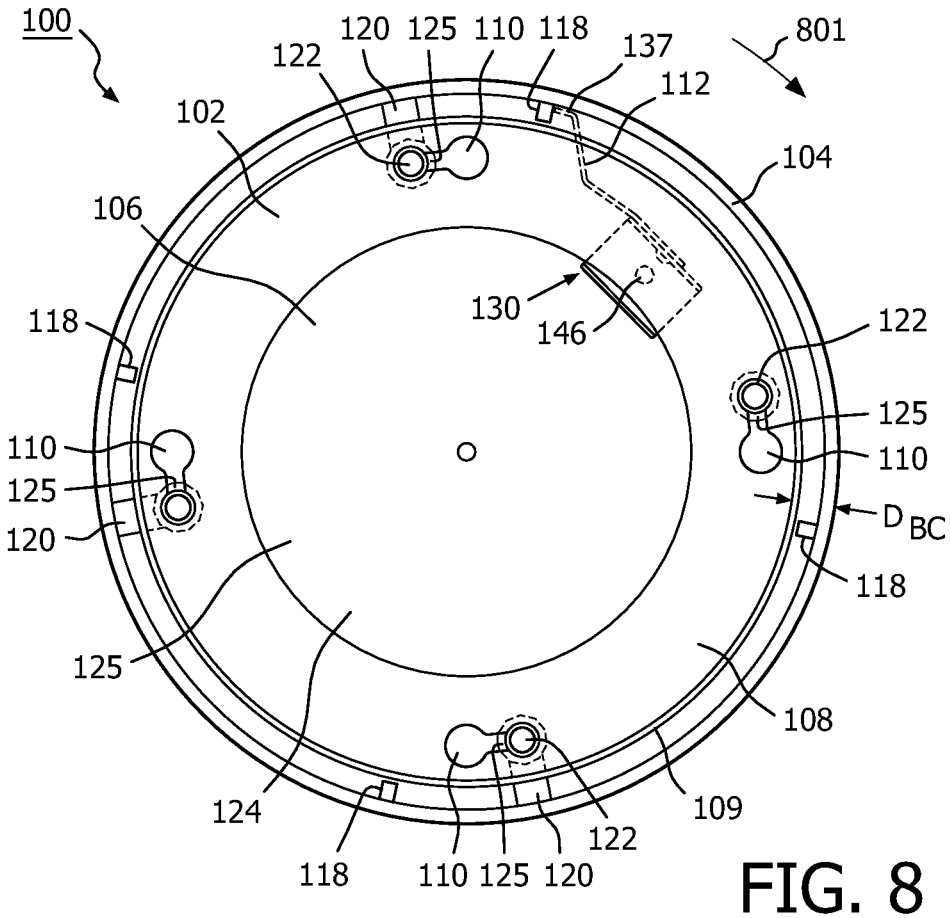
FIG. 8 is a bottom view of the base and the cover of the lighting fixture in the secured position in accordance with embodiments of the present system.

FIG. 8 is a bottom view of the base 102 and the cover 104 of the lighting fixture 100 in the secured position in accordance with embodiments of the present system. The cover 104 is secured to the base 102 by screws 122 which may engage the base portion 108 to firmly affix the cover 104 to the base 102. The engagement tab 137 of the spring 112 may be biased against the sidewall 116 of the cover 104 and may engage an adjacent one of the stop tabs 118 to prevent rotation (e.g., in the removal direction as shown by arrow 801) of the cover 104 relative to the base 102 when the spring 112 is in the latched position. Accordingly, unauthorized removal of the cover 104 from the base 102 may be prevented.

A process in accordance with embodiments of the present system of securing and locking the cover 104 to the base 102 will now be illustrated with reference to FIGS. 9-11. To facilitate the following illustrative discussion with reference to FIGS. 9-11, the spring 112 is shown in the latched position.

Figure 9:
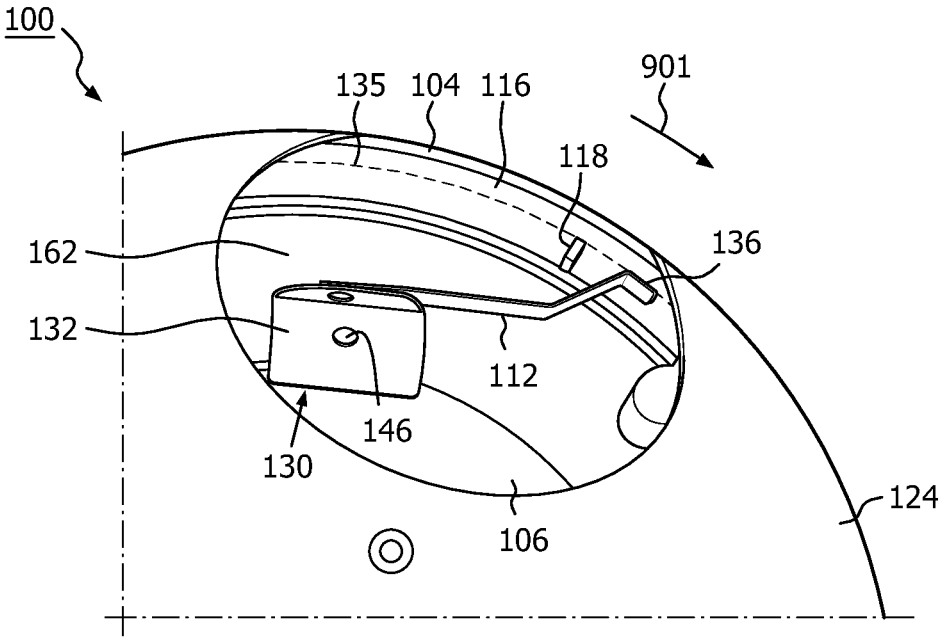
FIG. 9 is a detailed top perspective view of a portion of the lighting fixture in accordance with embodiments of the present system.

FIG. 9 is a detailed top perspective view of a portion of the lighting fixture 100 in accordance with embodiments of the present system. To secure the cover 104 to the base 102, a user may align the cover 104 and the base 102 such that the screws 122 (or studs, etc.) of the cover 104 are inserted within the elongated openings 110 of the base 110. Then, the user may rotate the cover in a securing direction relative to the base 102 as illustrated by arrow 901.

Figure 10:
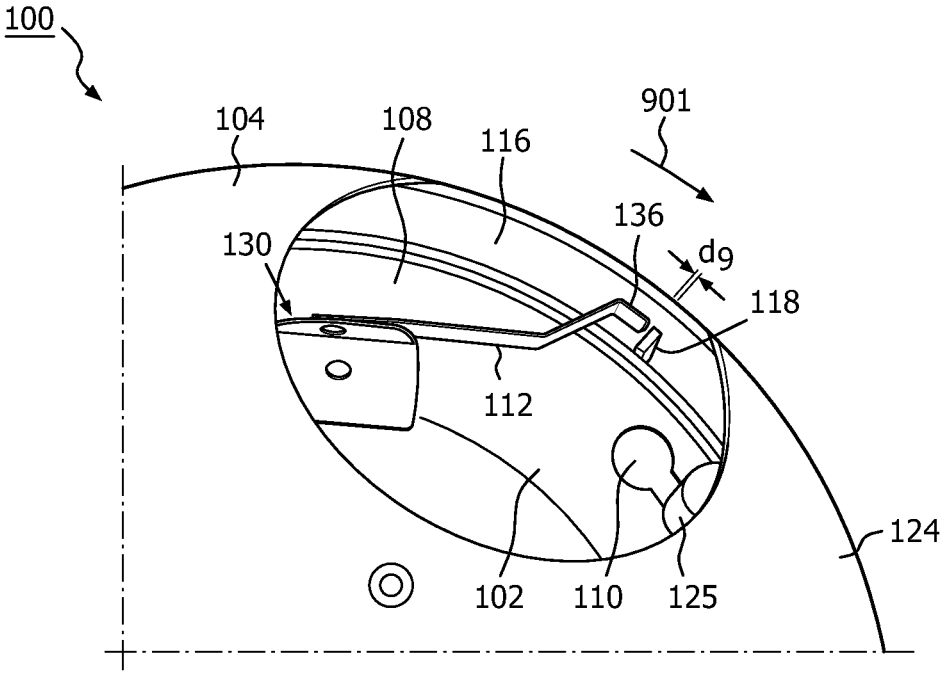
FIG. 10 is a detailed top perspective view of a portion of the lighting fixture in accordance with embodiments of the present system.

FIG. 10 is a detailed top perspective view of a portion of the lighting fixture 100 in accordance with embodiments of the present system. Further, rotation of the cover 104 relative to the base 102 may cause the stop tab 118 to rotate and contact and deflect the spring 112 until the stop tab 118 is rotated past the spring 112 after which the spring 112 deflects back (e.g., is biased) to its initial position against the side wall of the cover 104. Further, rotation of the cover 104 relative to the base 102 may be prevented by one or more of the screws 122 which contact a wall of the elongated openings 110. As shown in FIG. 10, the cover 104 is shown in the secured position relative to the base 102.

Figure 11:
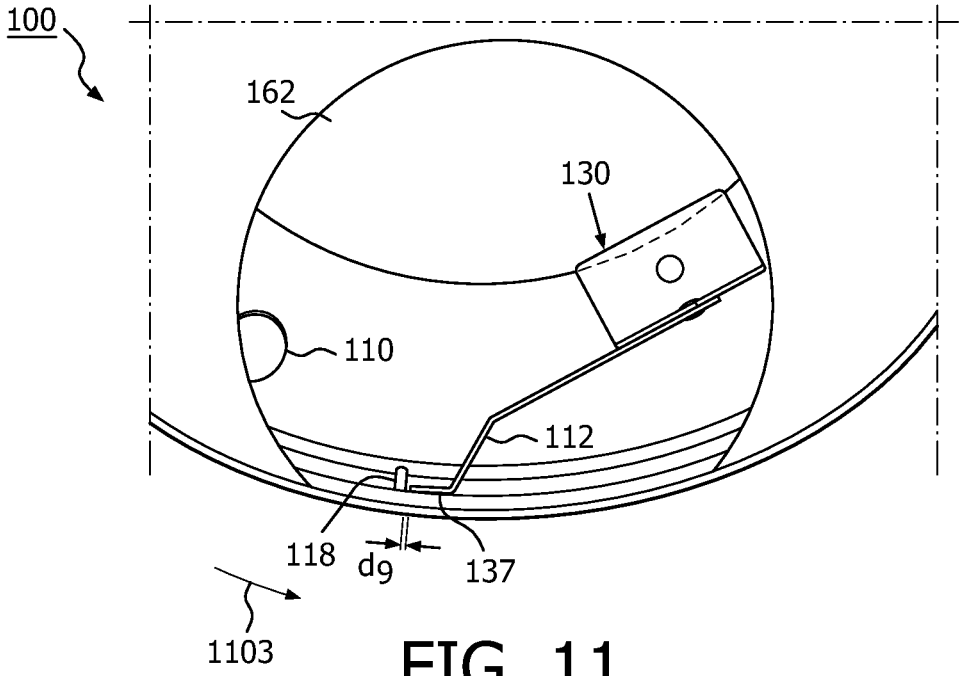
FIG. 11 is a detailed top perspective view of a portion of the lighting fixture in accordance with embodiments of the present system.

FIG. 11 is a detailed top perspective view of a portion of the lighting fixture 100 in accordance with embodiments of the present system. The cover 104 is shown in the secured position relative to the base 102. The engagement tab 137 of the spring 112 may be biased against the sidewall 116 of the cover 104 and may engage an adjacent stop tab 118 of the cover 104 to prevent rotation of the cover 104 relative to the base 102 when the spring 112 is in the latched position. As shown, rotation of the cover 104 relative to the base 102 in a removal direction is illustrated by arrow 1103. A slight gap between the engagement tab 137 and the adjacent stop tab 118 is illustrated by a distance $D_g$ and may be provided to prevent binding of the engagement tab 137 and the adjacent stop tab 118 when the cover 104 is in the secured position.

Figure 12:
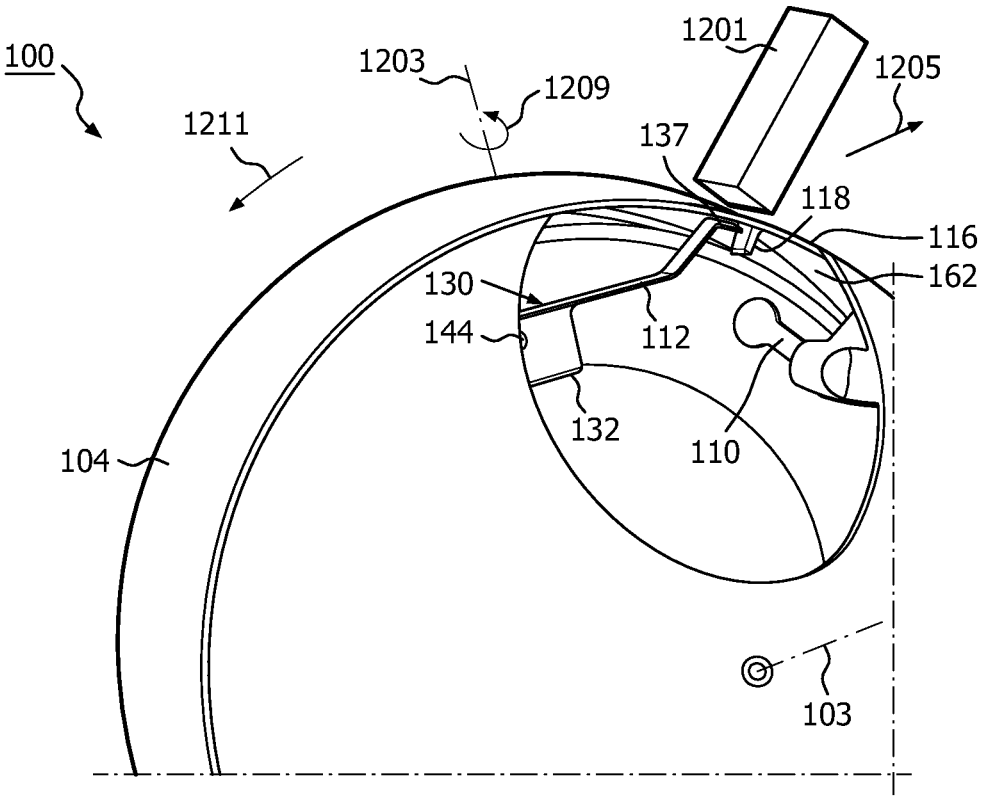
FIG. 12 is a detailed top perspective view of a portion of the lighting fixture during a cover removal process in accordance with embodiments of the present system.

FIG. 12 is a detailed top perspective view of a portion of the lighting fixture 100 during a cover removal process in accordance with embodiments of the present system. To remove the cover 104 from its secured position (as shown), a user may magnetically couple a magnet 1201 (e.g., a magnetic key to provide a magnetic force or attraction of a sufficient force) to the engagement tab 137 or other magnetic coupling part (e.g., a second magnet, a ferromagnetic portion, etc., of the spring configured to be magnetically coupled to the magnet 1201) of the spring 112 and transfer a force from the magnet 1201 to the spring 112 so as to rotate the spring 112 about its pivot axis 1203 (e.g., see, 303, FIG. 3, as illustrated by arrow 1209) and from the latched position to an unlatched position in which at least a portion of the engagement tab 137 may be aligned with the release area (e.g., see, 131, FIGS. 1 and 7, and 13) of the cover 104 (e.g., see, FIG. 13). This force (e.g., the force exerted upon the spring 112 by the magnet 1201 magnetically coupled thereto) may be in a direction of, for example, a vertical axis 103 of the lighting fixture 100 as illustrated by arrow 1205. When the spring 112 is in the unlatched position, it will not substantially act upon the adjacent stop tab 118 to prevent rotation of the cover 104 in a removal direction (e.g., indicated by arrow 211). To increase coupling forces, the spring 112 may include a secondary magnet which may, for example, be attached to the engagement tab 137 or other portion of the spring 112. However, it may be desirable to control the polarization of the secondary magnet such that it is in accordance with (e.g., opposite in pole) a pole of the magnet so that magnetic force coupling between the magnet and the secondary magnet may be enhanced. Further, if the spring 112 is formed from a non-ferromagnetic material such as stainless steel, plastic, etc., the spring 112 will require the secondary magnet or a ferromagnetic material to couple to the magnet 1201 so as to receive a force transmitted by the magnet 1201 to, for example, move the spring from a latched to an unlatched position or vice versa. It is further envisioned that in accordance with embodiments of the present system, a magnetic key (e.g., 1201) may be shaped and/or sized (e.g., round, square, patterned, etc.) to be slideably received by a corresponding area of the cover 102. Thus, in accordance with embodiments of the present system, magnetic keys 1201 which do not match a particular pattern in the cover 102 will not operate the latching mechanism of the present system. The magnetic key may include a suitable magnetic such as a ceramic magnet, a rare earth magnet, an electronic magnet, etc.

FIG. 13 is a detailed top perspective view of a portion of the lighting fixture 100 with the cover 104 partially rotated in a removal direction during the cover removal process in accordance with embodiments of the present system. With the spring 112 in the unlatched position, the cover 104 may be rotated in a removal direction as shown by arrow 1301. As the spring 112 is now in the unlatched position, it will not act upon the adjacent stop tab 118 to prevent rotation of the cover 104 in the removal direction. Arrow 1307 illustrates a direction that the spring 112 is displaced so as to rotate about its pivot axis 1203 as indicated by arrow 1309. When the cover 104 is rotated in the removal direction with the spring 112 in the unlatched position, portions of the spring 112 may contact the stop tab 118 but should not prevent rotation of the cover 104 in the removal direction.

FIG. 14 is a detailed top perspective view of a portion of the lighting fixture 100 with the cover 104 further rotated in a removal direction during the cover removal process in accordance with embodiments of the present system. The engagement tab 137 of the spring may clear the adjacent stop tab 118 and pass between the adjacent stop tab 118 and the cap 124 of the cover 104 when the cover 104 is rotated in the removal direction. When the cover 104 is sufficiently rotated, the securing mechanism may be released and the cover 104 may be removed from the base 102. Accordingly, a user may conveniently unlock and access internal components of a lighting fixture of the present apparatus.

Accordingly, a lighting fixture in accordance with embodiments of the present system may use a spring formed from a polymer or from a metal such as spring steel and may be operative as a "latch" which will "snap" in place during the installation of the cover of the lighting fixture. The spring is preferably made from a material which would couple to a magnetic key such as a ferromagnetic metal. Once the cover is in a secured position, the spring, when in its latched position, may contact the adjacent stop tab so as to prevent the removal of the cover by making it difficult if not impossible to rotate the cover from the cover's secured position (e.g., an installed position) without moving the spring to its unlatched position. The spring may be pivotally attached to a mounting bracket such that it may be toggled between its latched and unlatched positions. The mounting bracket may be attached to a base of the lighting fixture or may be formed integrally with the base. A biasing force may be provided to bias the spring into the latched position absent a force from a magnetic key to move the spring into the unlatched position. Accordingly, the latching mechanism of the present system may be operative regardless of a mounting position of the lighting fixture. It is envisioned that the cover may include markings such as graphics, indentations, etc., to indicate where the magnet should be placed to couple it to the spring and move the spring from its latched to its unlatched positions or vice versa. In accordance with embodiments of the present system, the spring may be shaped and/or sized to follow the interior contours of the rim of the cover.

A portion of the spring should be located proximate to an exterior portion of the lighting fixture such that it may be magnetically coupled to a magnet and may be moved from its latched to its unlatched positions, when the magnet (e.g., magnetic key) is coupled to the spring and thereafter manipulated in the correct direction. The cover and/or the base may be formed from a suitable non-ferrous material such as aluminium (e.g., stamped, cast, etc.), a polymer (e.g., plastic), etc. The latching mechanism may include indents so as to provide a force to hold position of the spring in a desired position such as the latched position, if desired, regardless of an orientation of the lighting fixture. The force provided by the indents should be easily overcome by the force from the magnet. Once the cover of the lighting fixture is removed, a user may gain access to internal components of the lighting fixture for maintenance, etc. Although not shown, a hinge may be provided to hingedly couple the cover to the base such that when the cover is in a released position relative to the base, the cover may be hingedly rotated to open the lighting fixture and gain access to internal components of the lighting fixture for maintenance, etc., without removing the cover from the base.

Accordingly, the present system provides an apparatus to conceal a latching mechanism of a lighting fixture and provides vandal resistance to prevent the opening of the top cap of lighting fixtures by unauthorized individuals such as vandals and the like. Thus, lighting fixtures in accordance with embodiments of the present system may be ideal for outdoor lighting in various indoor and/or outdoor mounting locations such as bollards, fixtures, etc. Moreover, because the locking system is hidden and easy to use, lighting fixtures in accordance with embodiments of the present system provide enhanced aesthetic and usability features. Further, because the latching mechanism is passive, only a single step or twist to secure and lock the cover to the base is required. Thus, assembly/repair time can be reduced over conventional vandal resistant lighting fixtures which can reduce assembly time and cost and enhance user convenience. Further variations of the present system would readily occur to a person of ordinary skill in the art and are encompassed by the following claims.

Finally, the above-discussion is intended to be merely illustrative of the present system and should not be construed as limiting the appended claims to any particular embodiment or group of embodiments. Thus, while the present system has been described with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise;

h) no specific sequence of acts or steps is intended to be required unless specifically indicated; and i) the term "plurality of" an element includes two or more of the claimed element, and does not imply any particular range of number of elements; that is, a plurality of elements may be as few as two elements, and may include an immeasurable number of elements.

What is claimed is:

1. A vandal resistant lighting fixture, comprising:

a base having a first side wall and a flange extending from the first side wall, the flange defining a first opening;

a cover having second sidewall and a cap extending from the second sidewall, the second sidewall having interior and exterior peripheries, the cap having second opening through which light from an illumination source may pass;

a securing mechanism configured to rotatably secure the cover to the base when the cover is rotated in a first direction relative to the base to a secured position; and a magnetically operable latching mechanism having latched and unlatched settings, wherein when the cover is in the secured position, the latching mechanism prevents rotation of the cover relative to the base in a second direction opposite the first direction when the latching mechanism is in the latched position.

2. The lighting fixture of claim 1, wherein the magnetically operable latching mechanism further comprises a bracket attached to the base; and a biasing member pivotally attached to the bracket so as to rotate about a pivot axis and into latched and unlatched positions respectively corresponding with latched and unlatched positions of the magnetically operable latching mechanism.

3. The lighting fixture of claim 2, wherein the biasing member comprises proximal and distal ends and an engagement tab situated proximate to the distal end and configured to be biased against the inner periphery of the second sidewall.

4. The lighting fixture of claim 2, further comprising at least one stop tab situated at the inner periphery of the second sidewall.

5. The lighting fixture of claim 4, wherein the at least one stop tab is configured to engage a portion of the biasing member when the biasing member is in the latched position.

6. The lighting fixture of claim 2, wherein the biasing member comprises a coupling portion configured to magnetically couple to a magnetic key to receive a force from the magnetic key to rotate the biasing member about the pivot axis to toggle the latching mechanism between the latched and unlatched positions.

7. The lighting fixture of claim 2, wherein the bracket comprises a Z-shaped bracket having first and second folds, the second fold situated at the first opening of the flange.

8. The lighting fixture of claim 1, wherein when the cover is in the secured position, the latching mechanism allows rotation of the cover relative to the base in the second direction opposite the first direction when the latching mechanism is in the unlatched position.

9. A method for forming a vandal resistant lighting fixture, the method comprising acts of:

forming a base having a first side wall and a flange extending from the first side wall;

forming a cover having a second side wall and a cap, the second sidewall having opposed inner and outer peripheries;

forming an opening in the cap through which light from an illumination source may pass;

configuring a securing mechanism to rotatably secure the cover to the base when the cover is rotated in a first direction relative to the base to a secured position; and forming a magnetically operable latching mechanism having latched and unlatched settings, wherein when the cover is in the secured position, the latching mechanism prevents rotation of the cover relative to the base in a second direction opposite the first direction when the latching mechanism is in the latched setting.

10. The method of claim 9, wherein the act of forming the magnetically operable latching mechanism further comprises acts of:

attaching a bracket; and pivotally attaching a biasing member having proximal and distal ends to the bracket such that the biasing member rotates about a pivot axis and has latched and unlatched positions respectively corresponding with latched and unlatched settings of the latching mechanism.

11. The method of claim 10, further comprising acts of:

forming an engagement tab at a proximal end of the biasing member; and situating the engagement tab such that the engagement tab is biased against the inner periphery of the other sidewall of the cover.

12. The method of claim 10, further comprising an act of forming one or more stop tabs at the inner periphery of the other sidewall of the cover.

13. The method of claim 12, wherein the one or more stop tabs are configured to engage the engagement tab when the biasing member is in the latched position and bypass the engagement tab when the biasing member is in the unlatched position.

14. The method of claim 10, further comprising an act of forming the biasing member from a ferromagnetic material configured to couple to a magnetic key to receive a force from the magnetic key to toggle the biasing member between the latched and unlatched positions respectively.

15. The method of claim 10, further comprising acts of:

folding the bracket twice in opposite directions between proximal and distal ends of the bracket so as to form a "Z" shaped bracket; and situating a portion of the bracket at the opening of the flange.

16. The method of claim 10, further comprising an act of configuring the biasing member such that when the cover is in the secured position, the biasing member allows rotation of the cover relative to the base in the second direction opposite the first direction when the biasing member is in the unlatched position.

17. A vandal resistant lighting fixture, comprising:

a base having a first side wall and a first flange extending from the first sidewall, the first sidewall having an outer periphery;

a cover having a second sidewall and a cap extending from the second sidewall, the second sidewall having inner and outer peripheries, the inner periphery of the second sidewall configured to extend about the outer periphery of the first sidewall of the base;

an opening situated in the cover through which light from an illumination source may pass;

a securing mechanism configured to rotatably secure the cover to the base when the cover is rotated in a first direction relative to the base to a secured position; and a magnetically operable latching mechanism comprising a biasing member having latched and unlatched positions, wherein when the cover is in the secured position, the latching mechanism prevents rotation of the cover relative to the base in a second direction opposite the first direction when the biasing member is in the latched position.

18. The lighting fixture of claim 17, wherein the magnetically operable latching mechanism further comprises a bracket attached to the base; and wherein the biasing member is pivotally attached to the bracket so as to rotate about a pivot axis and into latched and unlatched positions respectively corresponding with latched and unlatched positions of the magnetically operable latching mechanism; and wherein the biasing member comprises a magnetic coupling portion configured to magnetically couple to a magnetic key to receive a force from the magnetic key to rotate the biasing member about the pivot axis and to the latched or unlatched positions of the biasing member.

19. The lighting fixture of claim 17, further comprising a magnetic key configured to magnetically couple to the biasing member when the magnetic key is situated at the outer periphery of the second sidewall of the cover.

20. The lighting fixture of claim 18, wherein the biasing member further comprises a spring situated between a second flange attached to the base and the inner periphery of the second sidewall of the cover.

* * * * *